US006927735B2

(12) United States Patent
Lindenmeier et al.

(10) Patent No.: US 6,927,735 B2
(45) Date of Patent: Aug. 9, 2005

(54) ANTENNA ARRANGEMENT IN THE APERTURE OF AN ELECTRICALLY CONDUCTIVE VEHICLE CHASSIS

(75) Inventors: Heinz Lindenmeier, Planegg (DE); Jochen Hopf, Haar (DE); Leopold Reiter, Gilching (DE)

(73) Assignee: FUBA Automotive GmbH & Co. KG, Bad Salzdetfurth (DE)

( * ) Notice: Subject to any disclaimer, the term of this patent is extended or adjusted under 35 U.S.C. 154(b) by 34 days.

(21) Appl. No.: 10/373,549

(22) Filed: Feb. 25, 2003

(65) Prior Publication Data

US 2004/0164912 A1 Aug. 26, 2004

(51) Int. Cl.[7] ..... H01Q 1/32; H01Q 13/10
(52) U.S. Cl. ..... 343/712; 343/713; 343/767
(58) Field of Search ..... 343/711–713, 767

(56) References Cited

U.S. PATENT DOCUMENTS 4,737,795 A * 4/1988 Nagy et al. ..... 343/712

FOREIGN PATENT DOCUMENTS

DE 195 35 250 3/1997

* cited by examiner

*Primary Examiner*—Michael C. Wimer
(74) *Attorney, Agent, or Firm*—Collard & Roe, P.C.

(57) ABSTRACT

A radio antenna arrangement disposed in the conductive surface of a vehicle consisting of a substantially rectangular aperture having aperture length L and width B, wherein said aperture length L is sufficiently small so that the self-resonant frequency of the aperture is greater than the center frequency of the operating frequency range. There is a capacitive tuning element disposed in the aperture for tuning the aperture to a resonant frequency to approximately the center frequency of the operating frequency range. The capacitive tuning element serves as capacitive connection between the edges of the aperture, and is formed as a low-inductance element, so that due to the residual inductive effect, the remaining magnetic reactive power is as small as possible relative to the magnetically generated reactive power from the magnetic fields in the aperture. An input coupling element is also disposed in the aperture for coupling the antenna connection point to the resonance like high electromagnetic fields.

16 Claims, 13 Drawing Sheets

Fig. 2a
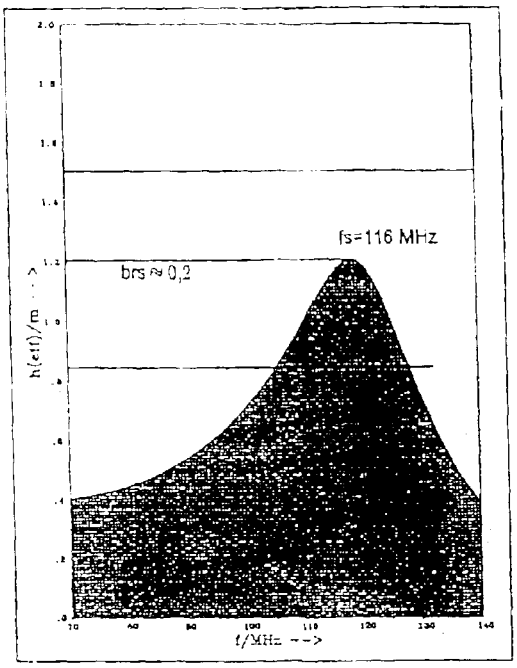
Fig. 2c
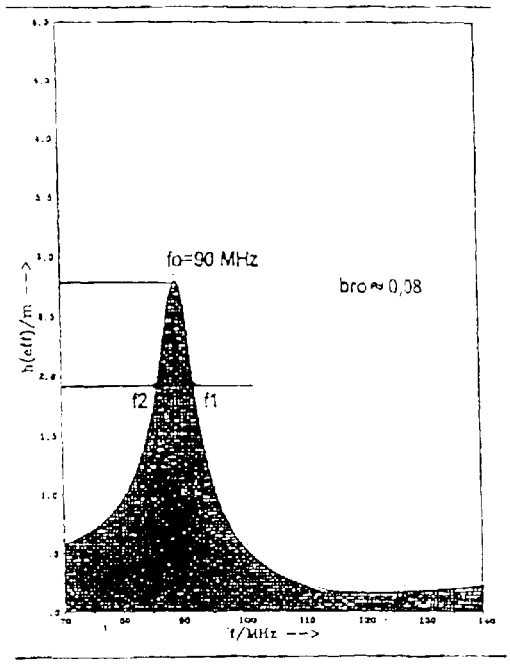
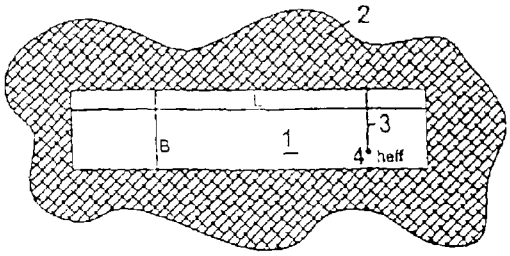
Fig. 2b
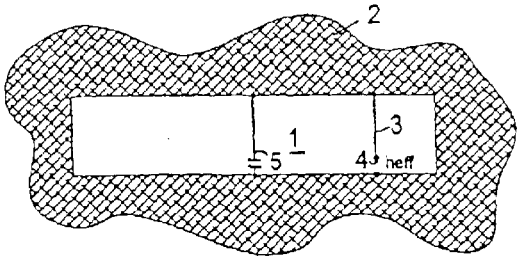
Fig. 2d

ANTENNA ARRANGEMENT IN THE APERTURE OF AN ELECTRICALLY CONDUCTIVE VEHICLE CHASSIS

BACKGROUND OF THE INVENTION

1. Field of the Invention

This invention relates to an antenna configuration in a primarily rectangular or trapezoidal aperture of an electrically conductive vehicle chassis in the meter wavelength range, for example for UHF reception.

2. The Prior Art

The invention is based on an antenna system as described, for example, in German Patent 195 35 250 A1 in FIG. 4*a* of the roof segment for a small vehicle. The antennas described therein for frequencies up to the meter wave length region are preferably designed as thin conductive wires. Due to the limited available space in vehicle construction, primary consideration for locating the above-described segments is given to roof segments or segments in the conductive trunk cover. The aperture length L is constrained by the width of the vehicle. Its aperture width B is also constrained by other technical structural requirements, e.g. sliding roof, roll-over security, etc. This results, in particular, in the range of meter wavelengths, to a choice of aperture length L often less than one-half of the operating wavelength, and an aperture width B less than 1/10 of the operating wavelength. In this case, the objective of a low-loss adaptation with the largest achievable bandwidth cannot be realized with the proposed antennas in FIG. 4*a* of German Patent 195 35 250 A1. Even for larger passenger cars, an aperture length L of greater than 90 cm is hardly available. This means that in the UHF range, for a center FM frequency of 97 MHz, an aperture length L of $L/\lambda=0.3$ with a relative bandwidth in the UHF region of (fmax−fmin/fm)=0.211. For the FM-Band in Japan with its center frequency of=83 MHz, this means that, for the wavelength of this frequency, a relative aperture length L of $L/\lambda=0.25$ with a relative bandwidth in the UHF region of fmax−fmin/fm=0.17. For the proposed antennas to conform to the impedances customary in antenna technology, they will have the disadvantage of a narrow bandwidth. Alternatively, the matching bandwidth can only be achieved with losses. For example, the operating frequency bandwidths in the above-referenced frequency bands, given the aperture lengths L of $L/\lambda=0.3$, and $L/\lambda=0.25$, respectively, cannot be realized with sufficiently low losses, i.e. the efficiency-bandwidth product is too small.

SUMMARY OF THE INVENTION

It is therefore an object of this invention to avoid the disadvantage of narrow bandwidth resulting from low-loss matching by using an antenna arrangement with an aperature length L, and an aperture width B which is less than 1/3 of the length, and disposed in the conductive vehicle chassis in the meter wavelength range, so that the resonant frequency is greater than the center frequency of the operating frequency range. The invention uses a capacitive tuning element to tune the resonance of the aperture close to the center frequency of the band. It is designed as a low inductance element so that due to the residual inductive effect, the remaining magnetic reactance is as small as possible relative to the magnetically generated reactive power from the magnetic fields in the aperture.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only, and not as a definition of the limits of the invention.

In the drawings, wherein similar reference characters denote similar elements throughout the several views:

FIG. 2*a* shows the frequency response of a no-load received voltage at the antenna output showing the self-resonant frequency of the aperture;

FIG. 2*b* shows a circuit used for the determination of the self-resonant frequency;

FIG. 2*c* shows the frequency response of a no-load voltage according to the invention, of the antenna showing the reduced resonant frequency due to tuning;

FIG. 2*d* shows the antenna according to the invention with an aperture tuned to the lower resonant frequency $f_o$ using a capacitive tuning element;

FIGS. 4*a* and *b* show bandwidth reduction as a function detuning with a parameter of undesired inductive effects in capacitive tuning element, wherein FIG. 4*a* shows the ratio of $b_{ro}$ with an inductive effect to $b_{ropt}$ without the inductive effect as a function of $f_o/f_s$ and, FIG. 4*b* shows ratio of $b_{ro}$ with inductive effect to $b_{rs}$ as a function of ratio of $f_o$ to aperture self-resonance $f_s$;

DETAILED DESCRIPTION OF PREFERRED EMBODIMENTS

Figure 1A:
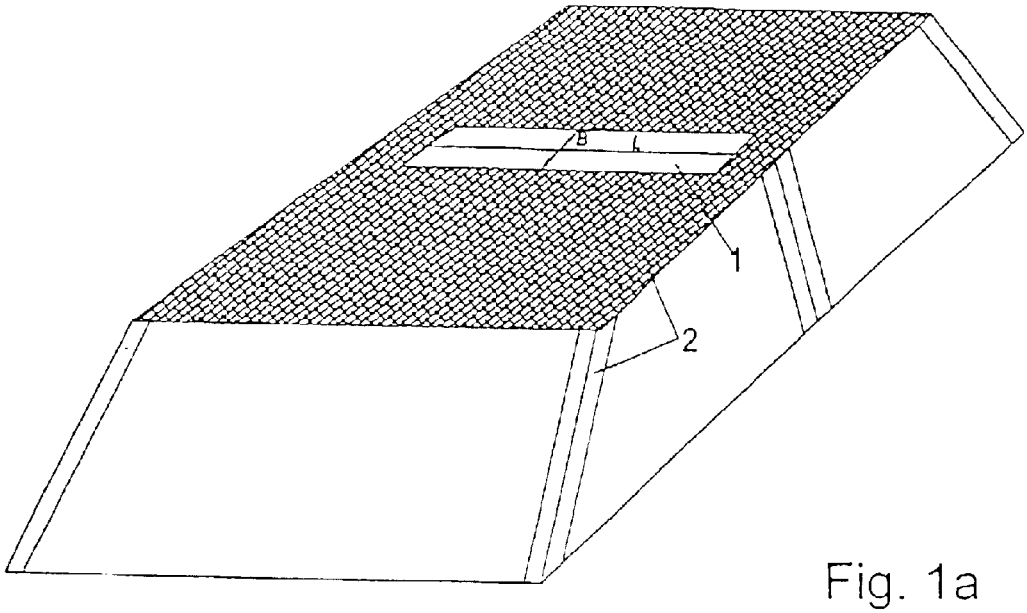
FIG. 1*a* is a sectional view in accordance with the invention of an antenna disposed in the conductive roof of a motor vehicle.
Figure 1B:
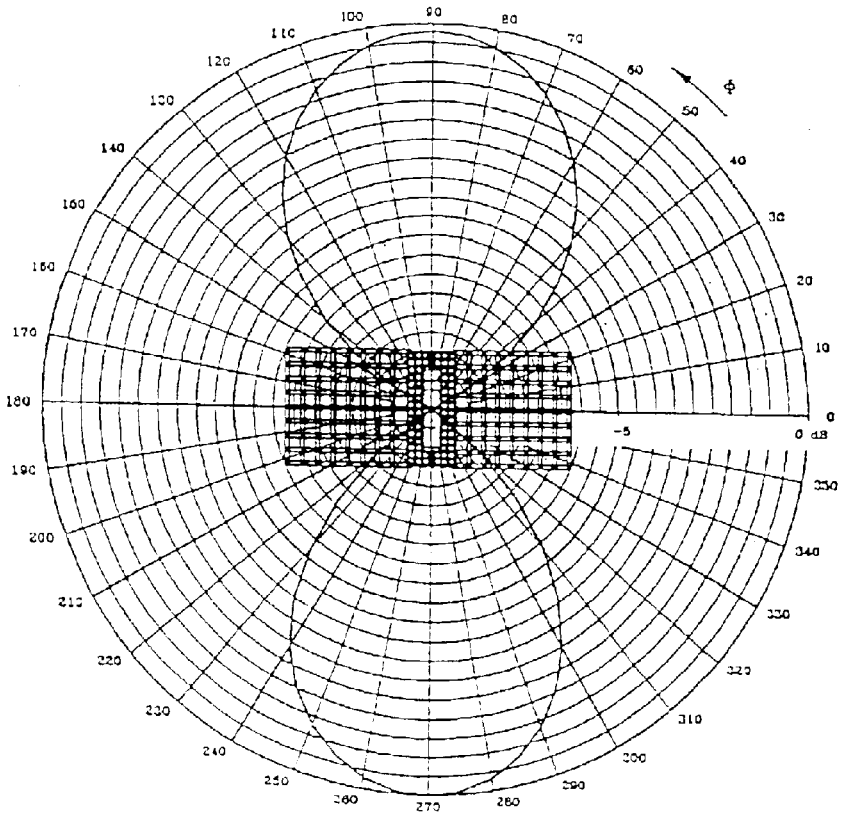
FIG. 1*b* shows the azimuth radiation pattern for horizontal polarization for frequencies lower than the aperture self-resonant frequency.

In connection with aperture lengths that are noticeably below the half-wave resonance, the radiation connected with an antenna in an aperture specified in the present invention is determined largely by the currents on the edge of the aperture. Referring to FIG. 1*a*, with an antenna of this type with an aperture length L and a width B, installed in the roof of a motor vehicle, a horizontal radiation, as shown in FIG. 1*b*, results with frequencies below the resonance of the aperture. The form of this directional diagram, which is applicable to the horizontal polarization for any type of excitation of aperture 1, is independent of the frequency to the extent that the latter does not exceed the resonance of the aperture. With respect to their own contribution to the radiation, antenna structures that are disposed in the aperture are therefore subject, at such frequencies, to the effects of the frame of the aperture. It is therefore important that the antenna structures mounted in the aperture be designed so that the edge currents of aperture 1 are excited with as little loss, and with the least possible reduction in the bandwidth.

With respect to its radiation properties, an aperture of the described type is similar in nature to a high-pass filter, whereby the frequencies above the natural resonance of the aperture can be particularly reached also with a larger width of the aperture with different antenna structures and positionings, and with different radiation diagrams. Moreover, relatively large bandwidths with a good degree of efficiency can be obtained with relatively slim antenna conductors. This has been evidenced in the past with the help of numerous shapes of window antenna conductors in motor vehicles.

To explain the invention, it is assumed in the following description that the antenna has an aperture that has a length of L=0.9 m, and a width B=0.2 m. Referring to FIG. 2*b*, this aperture is viewed with a coupling line 3 having a connection point or output 4. The mathematical relations specified in the following are not exactly applicable because of the distributed effect of all influences. However, these relations do describe the occurring phenomena with adequate accuracy and, with the help of the parameters that can be read from such phenomena, permit the translation of the stated data into a practical application.

Referring To FIG. 2*a* there is shown the dependence of the frequency, of the received voltage, as the effective height $h_{eff}$ when the antenna is impacted by the radiation in the main receiving direction. The maximal current received at the coupling element 3 is adjusted in this connection at the natural resonance frequency Fs of the aperture, which is reflected by a maximum value of the no-load voltage measured in the coupling site, the voltage being measured as the effective height. The relative bandwidth bre is defined according to the following relationship;

$$b_{rs} = \frac{f_1 - f_2}{\sqrt{f_1 f_2}} = \frac{f_1 - f_2}{f_s}. \tag{1a}$$

and is determined by the radiation attenuation and the reactive power conditions. The resonance frequency follows if the electrical reactive power caused in the aperture by the electrical fields is the same as the magnetic reactive power caused in the aperture by the magnetic fields. With frequencies that are below the resonance frequency, thus in connection with the short aperture lengths applicable here, the electrical reactive power in the aperture is too low to cause the desired resonance-like edge currents. According to the invention, this deficit of electrical reactive power is canceled by a capacitive tuning element 5, shown in FIG. 2*d*, so that the resonance-like currents are now generated at a lower frequency $f_o$, as is evidenced by the resonance-like, excessive rise or elevation of the effective height shown in FIG. 2*c*. Because of the radiation attenuation of the aperture which, based on the reactive power, is lower at the lower frequency $f_o$, the relative aperture bandwidth bro is as follows:

$$b_{ro} = \frac{f_1 - f_2}{\sqrt{f_1 f_2}} = \frac{f_1 - f_2}{f_o}. \tag{1b}$$

Bandwidth bro is smaller than at the natural resonance fe of the aperture. If the magnetic reactive power at the new resonance frequency $f_o$ is denoted by Pma, the electrical reactive power ΔPe required for de-tuning is supplied by $$\frac{\Delta P_e}{P_{ma}} = 1 - \left(\frac{f_o}{f_s}\right)^2. \tag{2}$$

which grows as the de-tuning rises. The optimal relative bandwidth, which can be reached in connection with this measure for the excessive resonance elevation of the aperture currents at $f_o$, is given by the ratio of the total magnetic reactive power Pma to the power P radiated in the event of transmission:

$$b_{ropt} = \frac{P_{ma}}{P}. \tag{3}$$

Figure 3A:
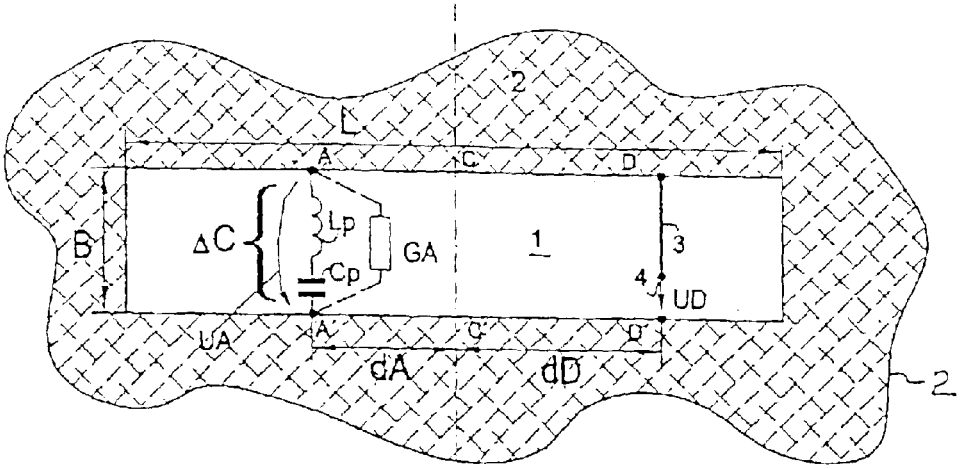
FIGS. 3*a* and 3*b* show the equivalent circuit diagrams to illustrate the effect of reduced bandwidth due to an inductive component in the capacitive tuning element.

According to the invention, capacitive tuning element 5 is effective with its effective capacity ΔC in the circuit of FIG. 3*a* between frame points A and A', whereby the conductance $G_A$ shown as a dashed line at that point represents the effective radiation attenuation of the circuit arrangement.

Figure 3B:
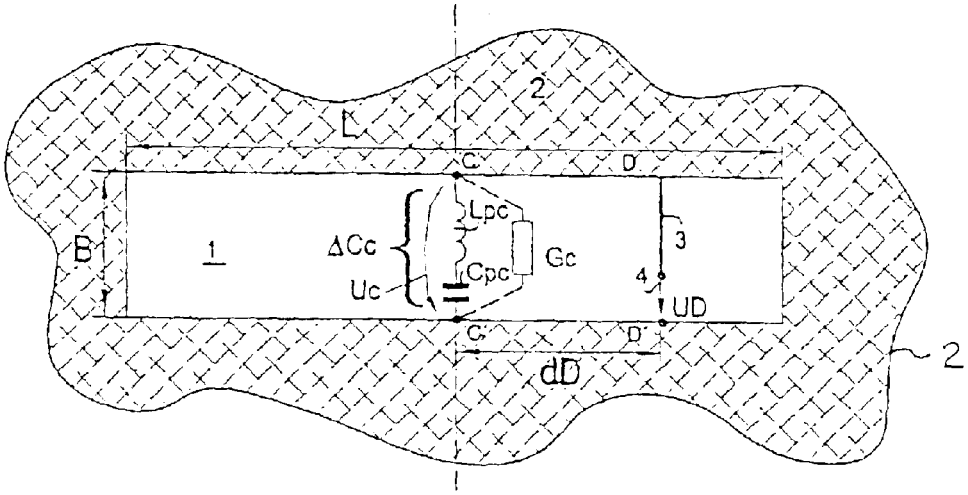

In comparison thereto, the circuit of FIG. 3*b* shows the tuning measure with the effective capacity Δc according to the invention being provided between framing points C and C' in the center of the length of the aperture. The relation between the conductances representing the radiation attenuation follows from the voltage ratio of $U_C$ to UA as follows:

$$G_A \approx G_c\left(\frac{U_c}{U_A}\right)^2. \tag{4}$$

and the relation between the effective capacitances is;

$$\Delta C = \Delta C_c \frac{G_A}{G_c}. \tag{5}$$

As the distance or spacing da grows, the voltage $U_A$ drops strongly in relation to the voltage $U_C$ toward the end of the aperture 1, so that both the effective capacity ΔC and the conductance according to the equations (4) and (5) representing the radiation at that point are rising strongly. In the circuit arrangements of FIGS. 3*a, b, c*, the effective capacities are each represented by the series connection of an inductance $L_p$ and $L_{po}$, respectively, and a capacitance $C_p$ and $C_{pc}$, respectively.

In the present invention, the effective capacity in the selected site in the aperture is designed with extremely low induction, i.e. with as little inductive effect as possible. If the effect of the series inductance is negligible, the bandwidth of the excessive resonance elevation of the electric and magnetic fields in the aperture is, within wide limits, practically independent of the position $d_A$ for mounting the capacitive tuning elements. At the frequency $f_o$, the maximal relative bandwidth $b_{ropt}$ is obtained. If the inductive reactive power $P_{mp}$ in the element $L_p$ cannot be neglected as compared to the magnetic reactive power $P_{ma}$ generated by the edge currents of the aperture, the relative bandwidth at the frequency $f_o$ is reduced to the value $b_{re}$, approximately according to the following relation:

$$\begin{aligned} b_{ro} &= \frac{P}{\sum P_m} \\ &= \frac{P}{P_{ma} + P_{mp}} \\ &= \frac{P/P_{ma}}{(1 + P_{mp}/P_{ma})} \\ &= \frac{b_{ropt}}{1 + P_{mp}/P_{ma}}. \end{aligned} \tag{6}$$

With $$\frac{P_{mp}}{P_{ma}} = \frac{\Delta P_e}{P_{ma}} \frac{P_{mp}}{\Delta P_e}. \tag{7}$$

the following in obtained jointly with equation (2) inserted in equation (6) for the relative bandwidth:

$$\begin{aligned} b_{ro} &= \frac{b_{ropt}}{1 + \left[1 - \left(\frac{f_o}{f_s}\right)^2\right]\frac{P_{mp}}{\Delta P_e}} \\ &= \frac{b_{ropt}}{1 + \left[1 - \left(\frac{f_o}{f_s}\right)^2\right]\omega_o^2 \Delta C L_p}. \end{aligned} \tag{8}$$

The influence of $L_P$ considerably reduces the bandwidth, whereby this influence increases with the increases de-tuning. The closer the resonance frequency $f_P$ $$f_p = \frac{1}{\sqrt{C_p L_p}}. \tag{9}$$

comes to the resonance circuit of the frequency $f_o$, which consists of $L_P$ and $C_P$, the stronger the bandwidth is narrowed at $f_o$. Furthermore, the following is therefore applicable:

$$b_{ro} = \frac{b_{ropt}}{1 + \frac{\left[1 - \left(\frac{f_o}{f_s}\right)^2\right]}{\left[\left(\frac{f_p}{f_o}\right)^2 - 1\right]}}. \tag{10}$$

Figure 4A:
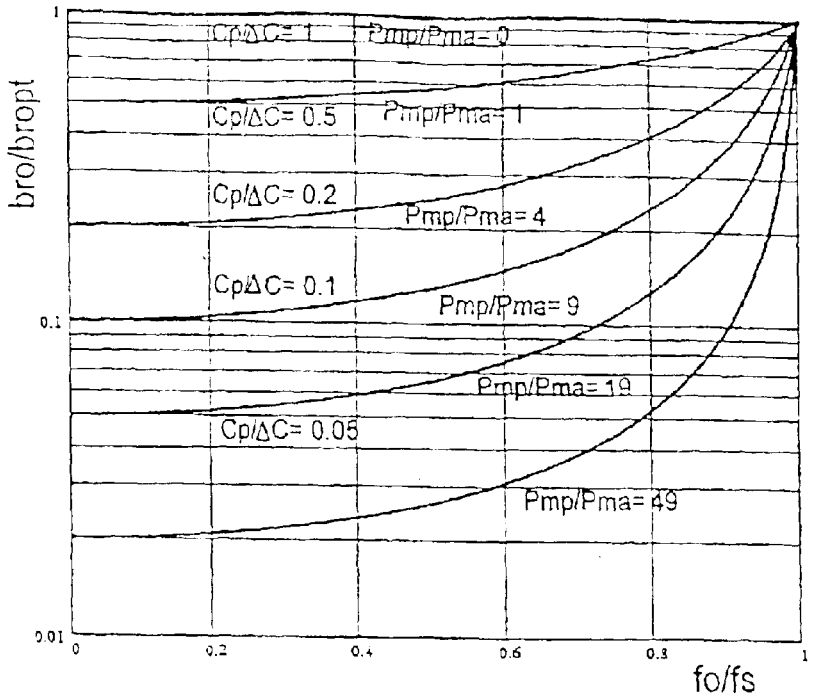
Figure 4B:
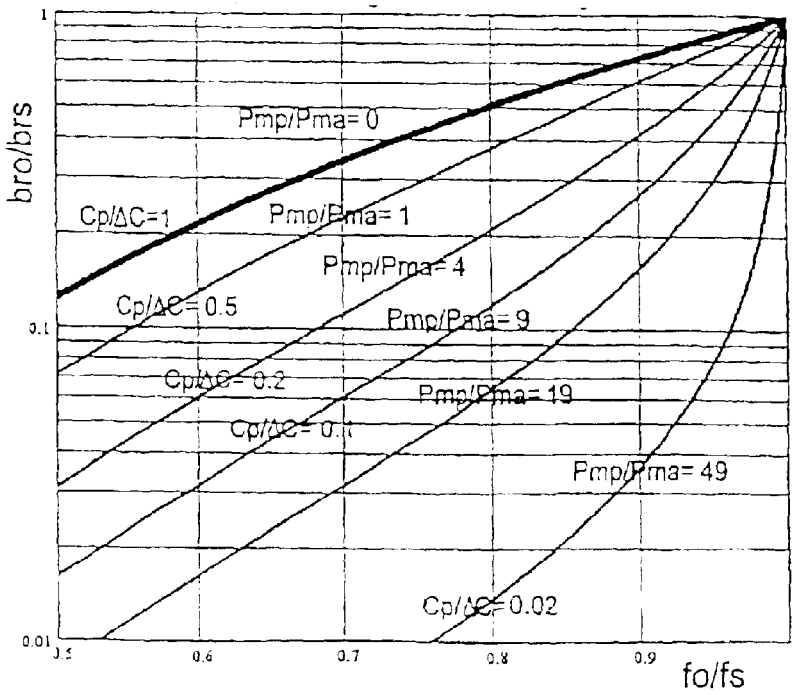

Referring to FIG. 4*a*, the reduction in the bandwidth in dependence of the influence of the undesirable magnetic reactive power occurring in dependence upon the frequency ratio $f_o/f_p$ is represented for different values of $C_p/C$ and PML/PSA, respectively. In addition, the influence of the undesirable magnetic blind power on the relation of the relative bandwidth BRE at the frequency $f_o$ to the relative aperture bandwidth BRE is represented in FIG. 4*b* at the natural resonance frequency $f_s$. It has been taken into account that at low frequencies, the optimally obtainable bandwidth for the current resonance decreases with the third power of the frequency. It is much more important that the bandwidth of the antenna arrangement not be reduced by any further disadvantageous coupling to the aperture. Maintaining the condition Pmp/ΔPc<<1 becomes more and more difficult as the spacing $d_A$ from the center increases. This follows from the equation (11) below, in association with the equation (4), because the following applies to the equally strong influence of the inductance $L_p$:

$$L_p = L_{pc} \cdot \frac{G_c}{G}. \tag{11}$$

For that reason, the capacitive tuning element has to be realized so that it is free of induction according to the invention, especially with tuning outside of the center of the aperture. It clearly follows from the above that a thin antenna conductor inserted in the aperture is not suited for supplying aperture 1 with reactive power $\Delta P_c$ required for the tuning since this is not possible without the magnetic reactive power $P_{mp}$ reducing the bandwidth, due to the conductor's own inductance.

Figure 3C:
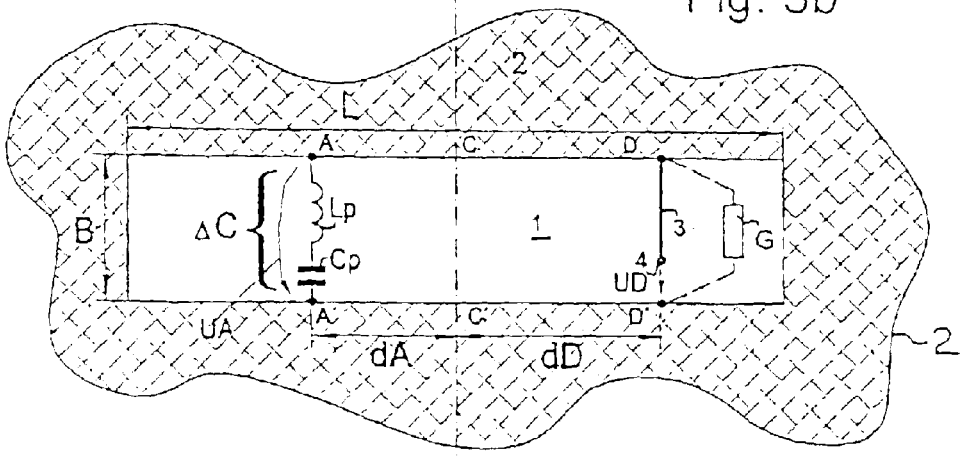
FIG. 3*c* show a circuit with a lossless impedance transformation to the desired impedance level, for frequencies below the self-resonant frequency of the aperture.

The invention is explained further using the example of an aperture 1 in body 2 of a vehicle, with an aperture length L of =90 cm and an aperture width of B=20 cm. The aim in connection with this example is to provide an antenna for an operating frequency range according to the ultra-short wave range in Europe, or according to the FM frequency range in Japan. If the capacitive tuning element 5 is installed in aperture 1 in the center of aperture length L as shown in FIG. 2*d*, a capacitance $C_{pc}$ of 5 pF suffices in this highly resistant site so as to reduce the natural resonance $f_e$=116 MHz of the aperture 1 to $f_o$=90 MHz. This is shown in the chart of FIG. 2*c*. In this connection, the relative bandwidth of the aperture resonance of $b_{re}$=0.2 is reduced to $b_{re}$=0.08. The conductance $G_c$ (FIG. 3*b*) that is effective in that site amounts to about 1 mS without capacitive de-tuning in the case of the natural aperture resonance $f_e$. The de-tuning acting on the resonance frequency $f_o$ viewed here, is reduced to approximately 0.54 mS. Together with the reactive power conditions altered at the lower frequency, this results in the stated de-tuning in the relatively strong reduction of the relative bandwidth $b_{re}$ of the aperture resonance. To position the coupling element 3 with the antenna connection site 4, the conductance of 0.54 mS conforming to a resistance of 1.86 kΩ is a value that is too high for realizing a simple, loss-free adaptation circuit. It is, technically speaking, significantly more favorable if coupling element 3 is positioned so that the impedance level available is in the order of magnitude of the desired antenna impedance, whereby the conductance G in FIGS. 3*a* and 3*b* strongly increases as the distance $_{dD}$ from the center line of the aperture 1 increases. This impedance level is determined by the conductance in FIG. 3*c* which, in the sites D and D', represents the total damping of the radiation of the aperture, whereby, analogous to equation (3), that the impedance level strongly decreases toward the end of the aperture according to the equation below, and can be adjusted to the desired value by selecting a suitable spacing dD. Approximated, the following is the result for the conductance G:

$$G \approx G_c\left(\frac{U_c}{U_D}\right)^2. \tag{12}$$

Figure 6A:
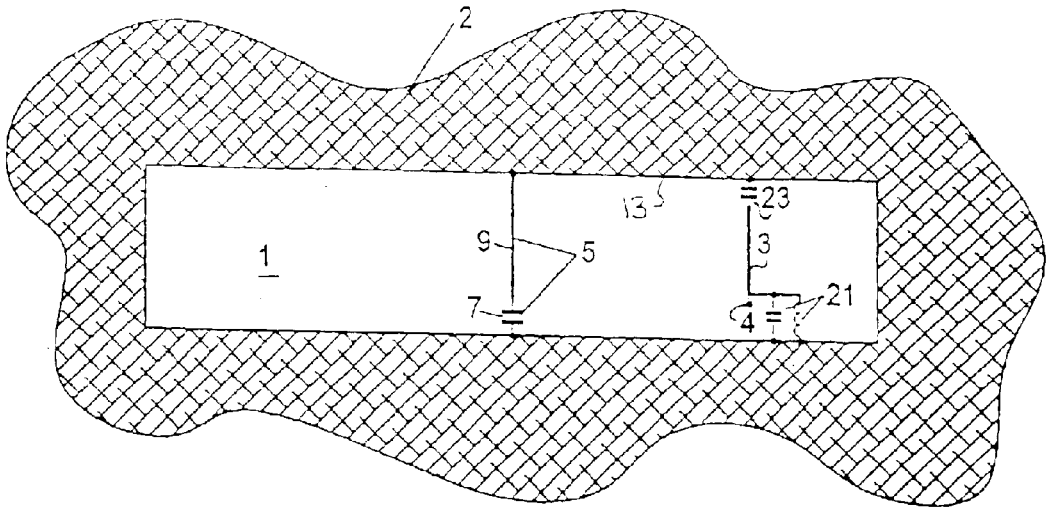
FIG. 6*a* shows a circuit having a capacitive tuning element with a low capacitance located at center of the aperture.

In FIG. 6*a*, this transformation, which can be viewed as a practically loss-free measure, can occur using an equivalent resonance band pass filter with two resonance circuits. Here, aperture 1 acts as a resonance circuit that is tuned to the frequency $f_o$. With the help of coupling capacitance 2 in coupling element 3, jointly with the low-loss reactive elements 21, connected in parallel, which, become the second resonance circuit of the antenna connection site 4, it is possible to generate the broad-band impedance curve shown in FIG. 6*b* in a low-loss manner.

This impedance curve, shown with a wide-band loop within the chart, shows that the impedance, that is optimal for adapting the noise to a transistor, the FM-band in Japan (76 to 90 MHz=the operating frequency range), is low in comparison to the natural resonance frequency of aperture 1. It is shown in the following that the resonance of the aperture can be produced in different ways in an equivalent manner without having to change coupling element 3, without regard to measures implemented for fine tuning.

Figure 7A:
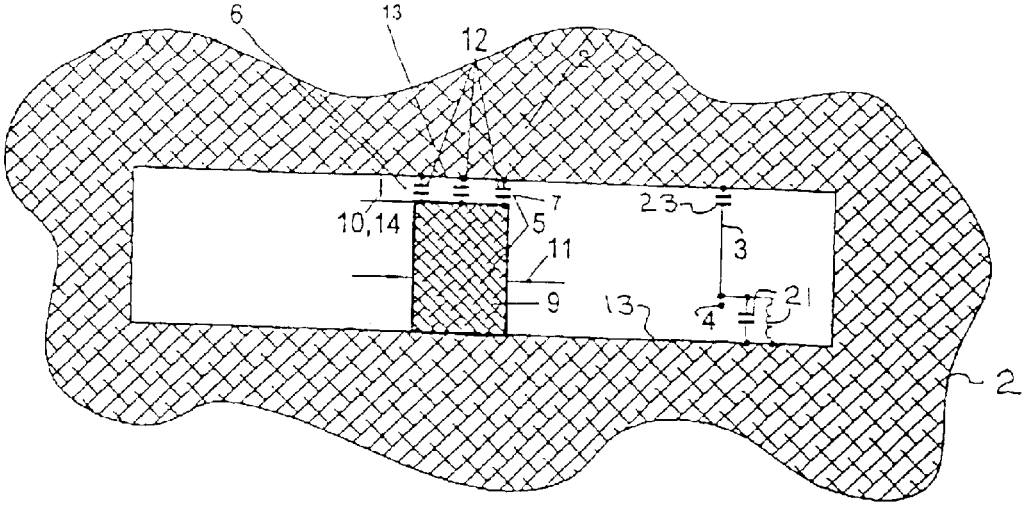
FIG. 7*a* shows a circuit similar to that of FIG. 6*a* but with a wider low-capacitance conductor.

In FIG. 7*a*, the low-inductance conductor 9 is designed as a flat conductor with an adequately broad conductor width 11. Here, it is possible to employ the concentrated capacitive construction elements 12 to bridge the interruption point or gap 6. To prevent any undesirable inductive effect, a plurality of such capacitive construction elements 12 are distributed over the conductor width 11.

Another way to design the capacitive tuning element 5. with the desired effective capacity ΔC is to design the gap 6 as a slotted capacitance, that can be adjusted by selecting a suitable conductor slot width 14. With the circuit of FIG. 7*a*, it is possible to provide for the preset frequency range with a practically unchanged design of the coupling elements 3, and with an impedance curve that is equivalent to FIG. 6*b*. By placing the tuning components on the center line as shown in FIG. 3*b*, the effect of the conductor inductance $L_{pc}$ is, in this connection, sufficiently low for using in an equivalent manner conductors with a cross section as in FIG. 6*a*, wherein this cross section is advantageously small for space reasons. This follows from the equivalent impedance curves shown in FIGS. 6*b* and 7*b*.

Figure 5A:
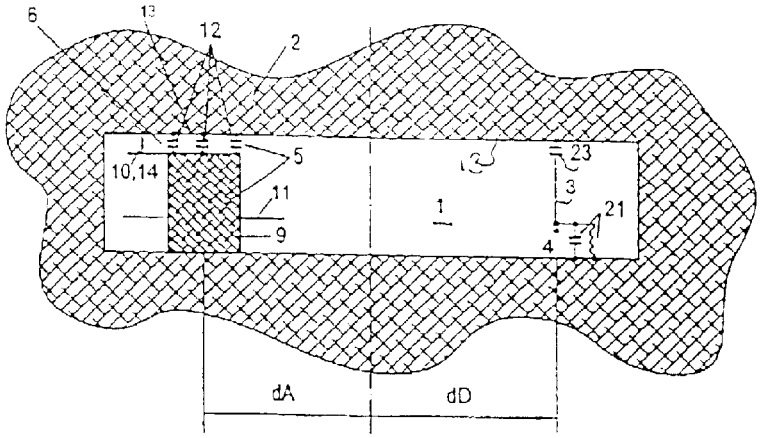
FIG. 5*a* shows a circuit having a capacitive tuning element with a low inductance conductor and an input coupling element using capacitive coupling and a parallel resonator circuit to provide a dual resonant band filter circuit.
Figure 5B:
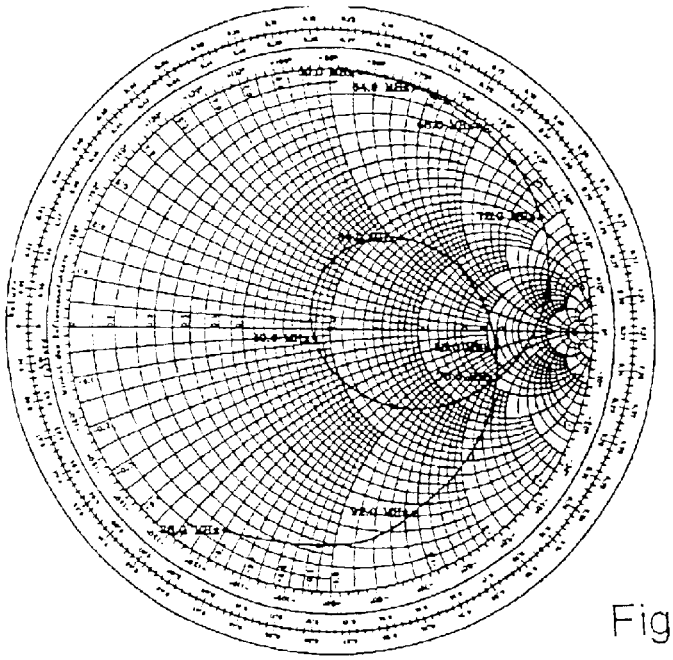
FIG. 5*b* is a chart of the antenna impedance at the antenna input terminal the circuit of FIG. 5*a* for the FM-Band in Japan.
Figure 6B:
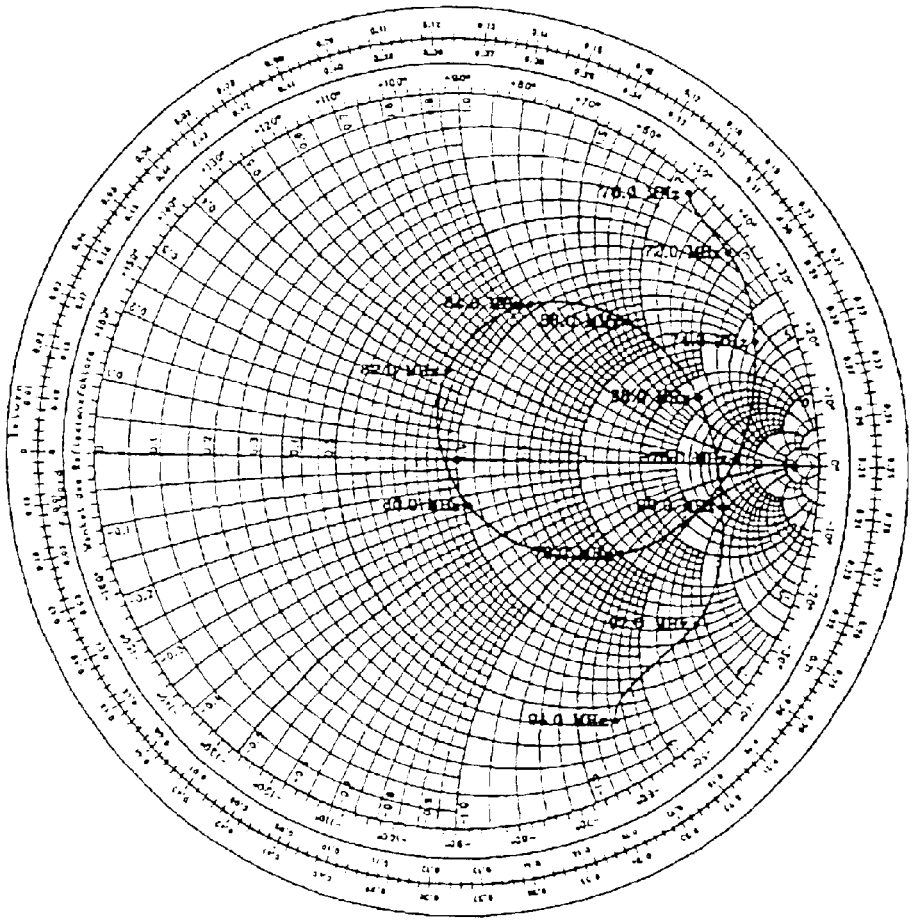
FIG. 6*b* is a chart showing the equivalent tuning to same resonant frequency of the aperture as in FIG. 5*a*, providing a similar impedance response as in FIG. 5*b* with the circuit arrangement of FIG. 5*a*.
Figure 7B:
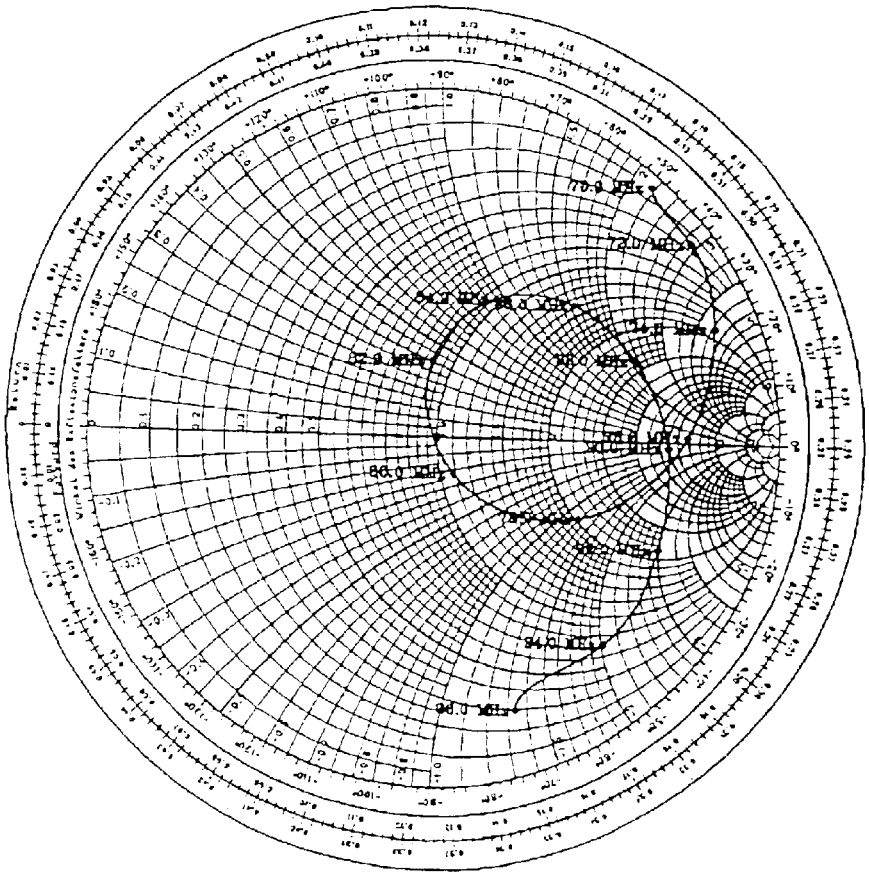
FIG. 7*b* shows the impedance pattern for the arrangement in FIG. 7*a*, similar to that shown in the chart of FIG. 6*b;*

In FIG. 5*a*, there is show another advantageous way to provide the capacitive tuning element 5. Here, capacitive tuning element 5 is mounted in aperture 1 with a notable spacing $d_A$. For reasons of the substantially greater capacitance $C_p$ required than with a mount located in the center, the effect of the inductance $L_p$ is greater than the one of an inductance $L_{pc}$ of the same size mounted in the center (see equation 11). A flat design of the low-inductance conductor 9 is advantageous for that reason. By suitably selecting the capacitive construction element 7 with the introduction of the concentrated capacitive construction elements 12 at a preset edge spacing 10, or with suitable selection of a conductor slot width 14 in conjunction with a conductor width 11 selected to be adequately large, it is possible to obtain the impedance curve shown in FIG. 5*b*. A comparison of the impedance curves of FIGS. 6*b*, 7*b* and 5*b* shows that all of the designs represented in FIGS. 6*a*, 7*a* and 5*a* for tuning the resonance of the aperture are practically equivalent.

Figure 5C:
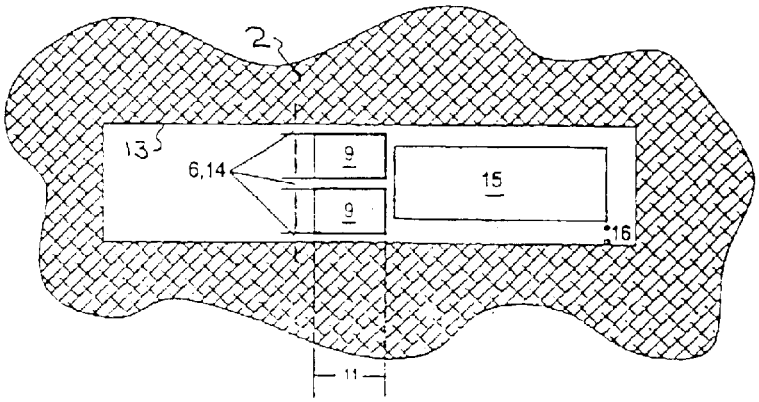
FIG. 5*c* shows a circuit with low-inductance conductors with discontinuities for minimizing the screening effect of a nearby LMK receiving antenna element using an LMK connection point.
Figure 5D:
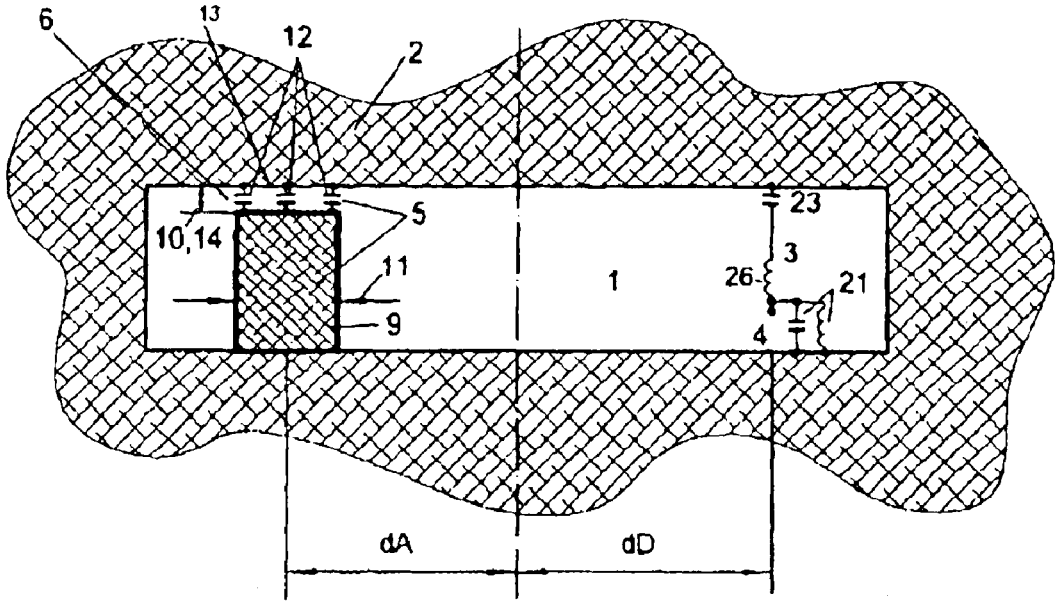
FIG. 5*d* shows a circuit similar to the circuit of FIG. 5*a* except that the input coupling elements include a series inductance to form a triple bandpass filter circuit having an enlarged bandwidth.

FIG. 5d shows an antenna embodiment wherein the input coupling element 3 additionally includes a series inductance 26 wherein the inductance value thereof, in combination with the input coupling capacitance 23, and the low-loss reactive elements 21 form a triple bandpass filter circuit having an enlarged bandwidth.

Figure 8A:
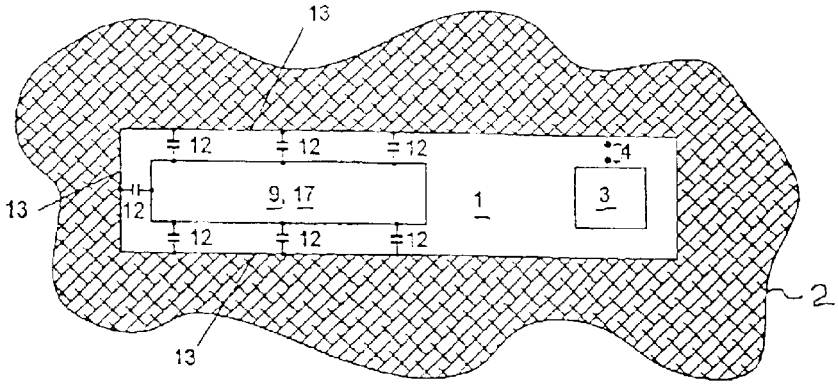
FIG. 8*a* shows a circuit for broad band performance of a low-inductance conductor with capacitive element, and a separate capacitive coupling element with an antenna connection point.
Figure 8B:
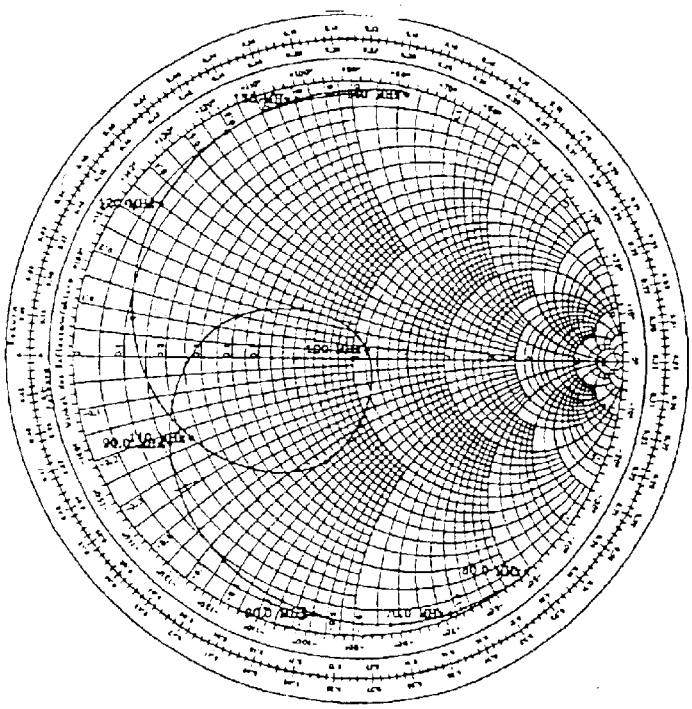
FIG. 8*b* shows an impedance pattern at the antenna connection point for the arrangement in the circuit of FIG. 8*a;*

Referring To FIGS. 8*a* and 8*b*, a further advantageous embodiment of the invention is shown, wherein capacitive tuning element 5 is introduced in the aperture as a larger surface with a longitudinal dimension measuring up to half of the length L of the aperture, in the form of the low-inductance conductor 9. The desired capacitive overall effect is produced by the edge spacing 10 between the frame of this conductive surface 17, and aperture edges 13, in association with the suitable, concentrated capacitive construction elements 12, which are disposed in a distributed manner.

Figure 8C:
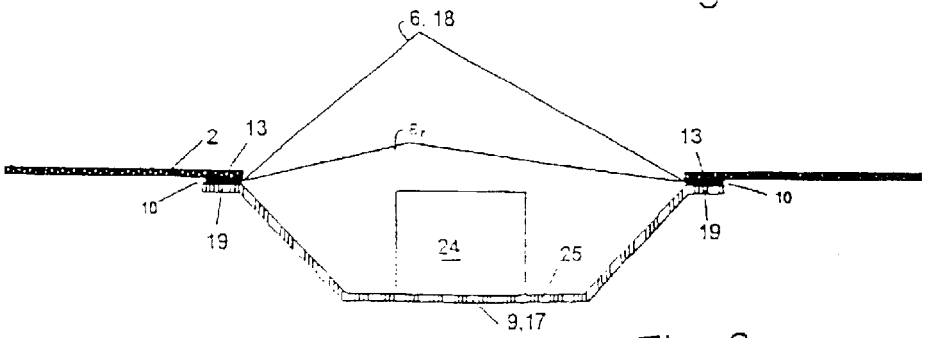
FIG. 8*c* shows a trough-like low-inductance conductor with dielectric, for tuning the required distributed capacitance between the edge of the trough and the edge of the aperture, wherein the microwave antenna utilizes the trough as a ground plane.

To produce combined antenna systems in aperture 1, it is advantageous if conductive surface 17 of capacitive tuning element 5 is designed as a tub, as shown in FIG. 8*c*, for receiving additional antennas for other frequency ranges. This tub can be advantageously designed as a conductive base surface 25 of the microwave antennas 24. To extend or install the connection lines out of aperture 1, the lines are designed in a highly resistant manner for the meter-wave frequency range by impeding them.

Because of the residual or remaining small edge spacing 10, the contribution of the area of the apertures bridged with the tub contributes less to the formation or development of self-inductance. Moreover, the coating of the capacitance has to be increased accordingly while the basic properties of the tuned aperture, have to be preserved. Similar to the conductive surface shaped in the form of a tub, it is, of course, not necessary to mount coupling element 5 in the plane of the body of the vehicle surrounding aperture 1. The coupling element can also be recessed just as deep on a dielectric carrier material in aperture 1.

Figure 11A:
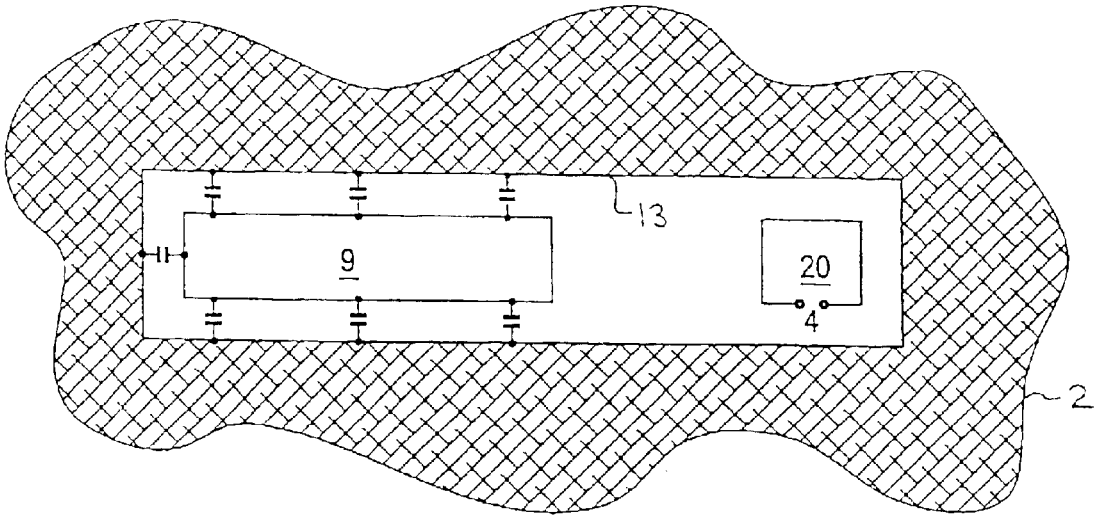
FIG. 11*a* shows a fundamental circuit for the construction of a coupling element serving as a magnetic dipole.
Figure 11B:
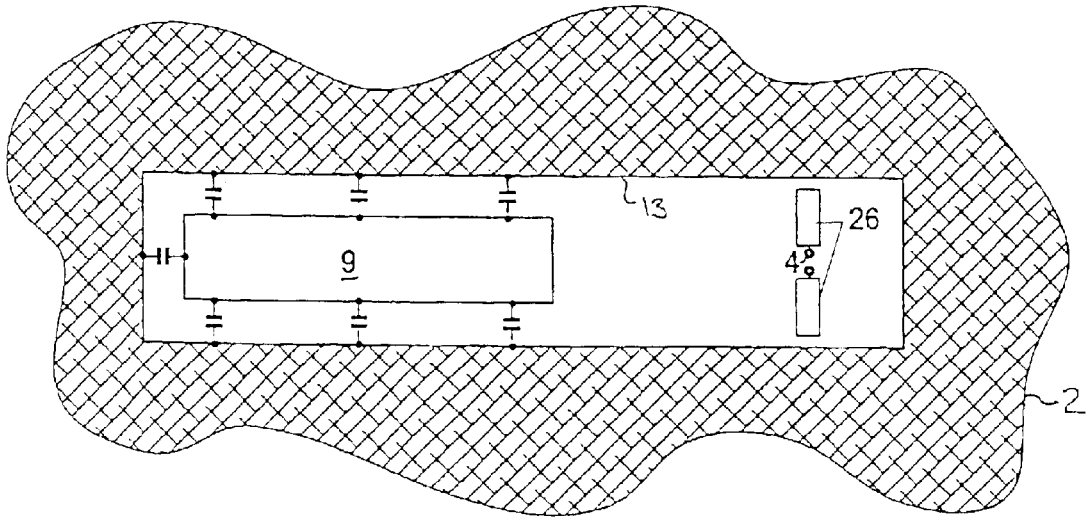
FIG. 11*b* shows a fundamental circuit for the construction of a coupling element serving as an electric dipole.

Referring to FIGS. 11 and 11*b*, the circuits use dipoles to replace coupling element 3. Coupling element 3, with its antenna connection site 4 for coupling to the magnetic field that is excessively elevated in a resonance-like manner, or for coupling to the electrical field in aperture 1 that is excessively elevated in a resonance-like manner, can be designed using a magnetic dipole 20, or with an electrical dipole 26.

Figure 9A:
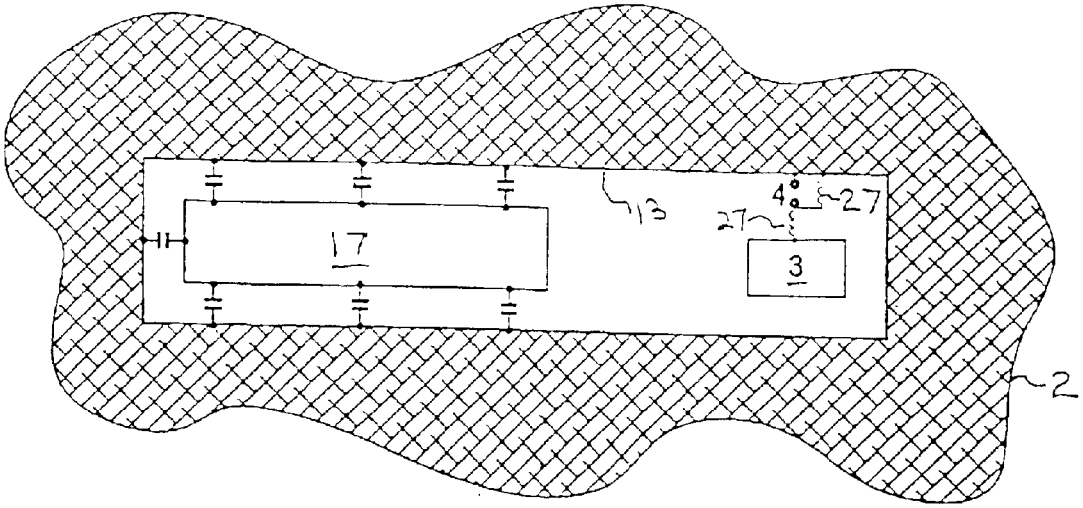
FIG. 9*a* shows a circuit as in FIG. 8*a*, wherein the capacitive input coupling element is a simple transformer circuit.
Figure 9B:
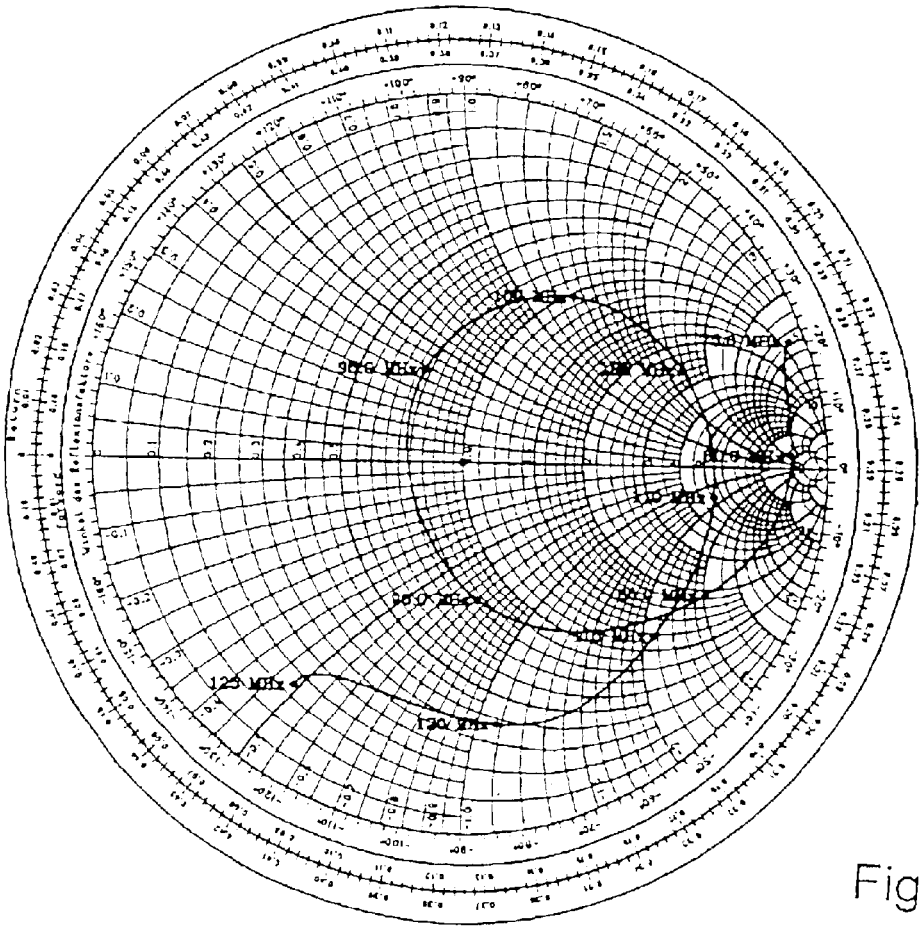
FIG. 9*b* shows the impedance pattern at the antenna connection point for the circuit of FIG. 9*a* for the UHF Band operating frequency range.

Magnetically, acting coupling elements 3 for de-coupling the strong magnetic fields at the end of aperture 1 are additionally shown in FIGS. 2*b*, 2*d*, and 3*a*, 3*b*, 3*c*. Uncoupling with an electrical monopole is shown in FIG. 8*a*. The associated impedance curve in FIG. 8*b* shows the wide-band property of this arrangement at the antenna connection site 4, which advantageously permits the transformation into the desired impedance curve in FIG. 9*b* with the simple, low-loss reactive choke elements 27 indicated in FIG. 9*a*. Coupling element 3 is connected to antenna ground 13 thru series connected chokes 27, wherein connection point 4 is formed across one of the chokes.

In FIGS. 5*a*, 6*a* and 7*a*, there is shown a particularly advantageous coupling to aperture 1 represented by the above-mentioned capacitive coupling for providing an equivalent resonance band pass filter with two circuits.

Figure 10A:
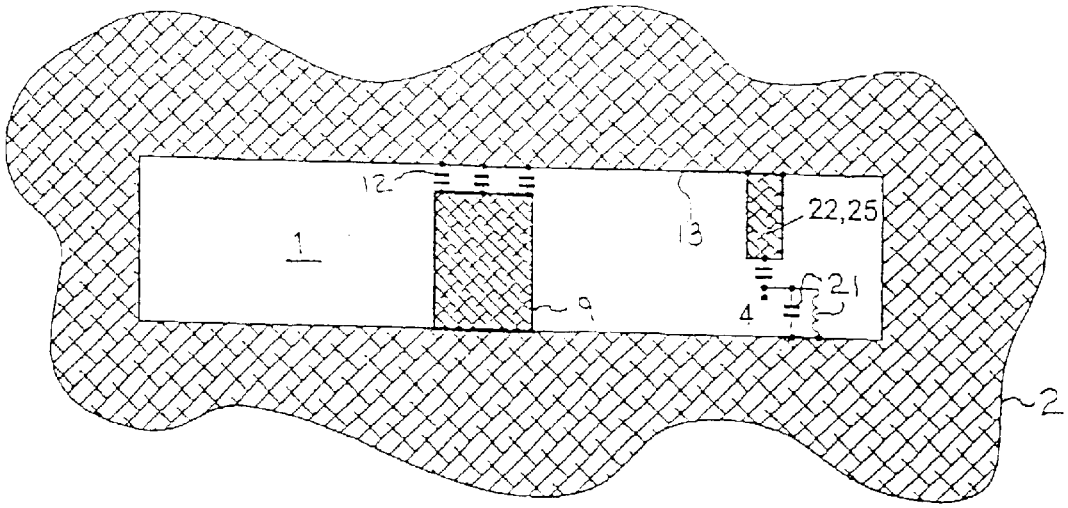
FIG. 10*a* shows a circuit similar to FIG. 7*a*., except the flat conductor is conductively connected to the vehicle chassis as a possible conducting ground plane for a microwave antenna in a combination antenna system.
Figure 10B:
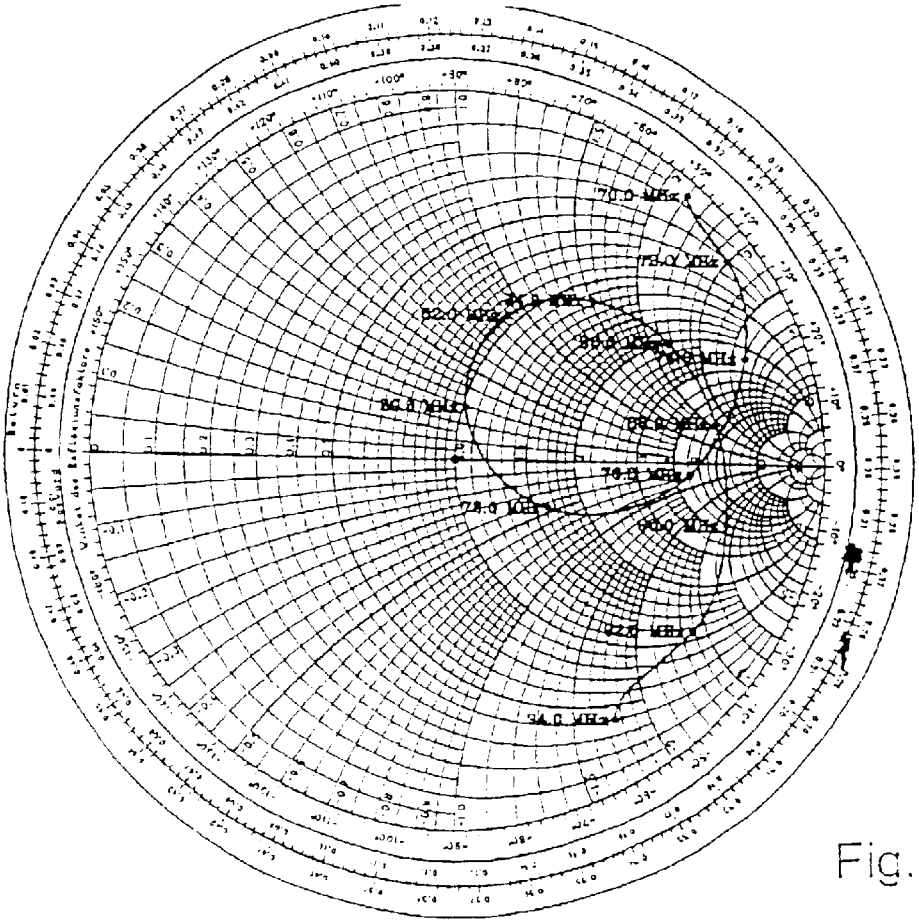
FIG. 10*b* shows the impedance pattern for the embodiment in FIG. 10*a* at the antenna connection point for the operating frequency range of the FM Band in Japan.

FIG. 10 shows an especially advantageous variation of the design of coupling element 3, to provide combination antennas, where the substantially stretched conductor 22 is grounded at one end with edge 13 of the aperture. With a flat design of stretched conductor 22, the latter can be advantageously employed as the conductive base surface 25 of the microwave antennas 24 in a combined antenna system. Owing to the ground coupling, the connection lines of the microwave antennas 24 can be extended outwards without any problem.

If the combined antenna system in aperture 1 is to be designed to accommodate an antenna for the long, medium, short-wave frequency range as well, capacitive tuning element 5 can be beneficially mounted in the area of the center of aperture 1 to avoid screening effects, and low-inductance conductor 9 may contain a plurality of interruption sites 6 or gaps as indicated in FIG. 5*c*. The screening effect on a neighboring long, medium and short wave receiving antenna element 15 with its long, medium, and short wave connection site 16 is noticeably reduced in this way.

Figure 12A:
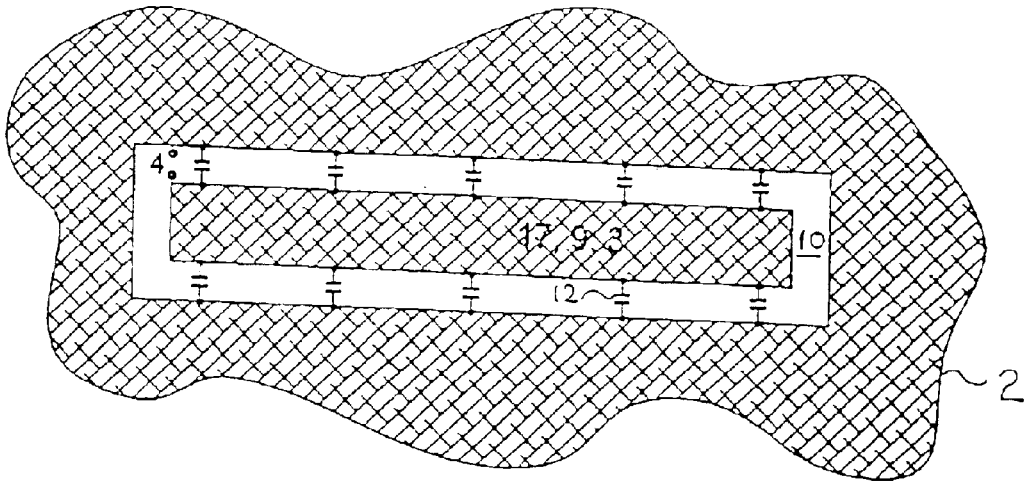
FIG. 12*a* shows an antenna configuration used for broad banding using a conducting plane, serving as a low-inductance conductor that covers almost the entire aperture length for combined use as a coupling element with an antenna connection point; and, FIG. 12*b* shows an impedance pattern for the embodiment of FIG. 12*a* for the connected broadband transformation for the UHF frequency region.
Figure 12B:
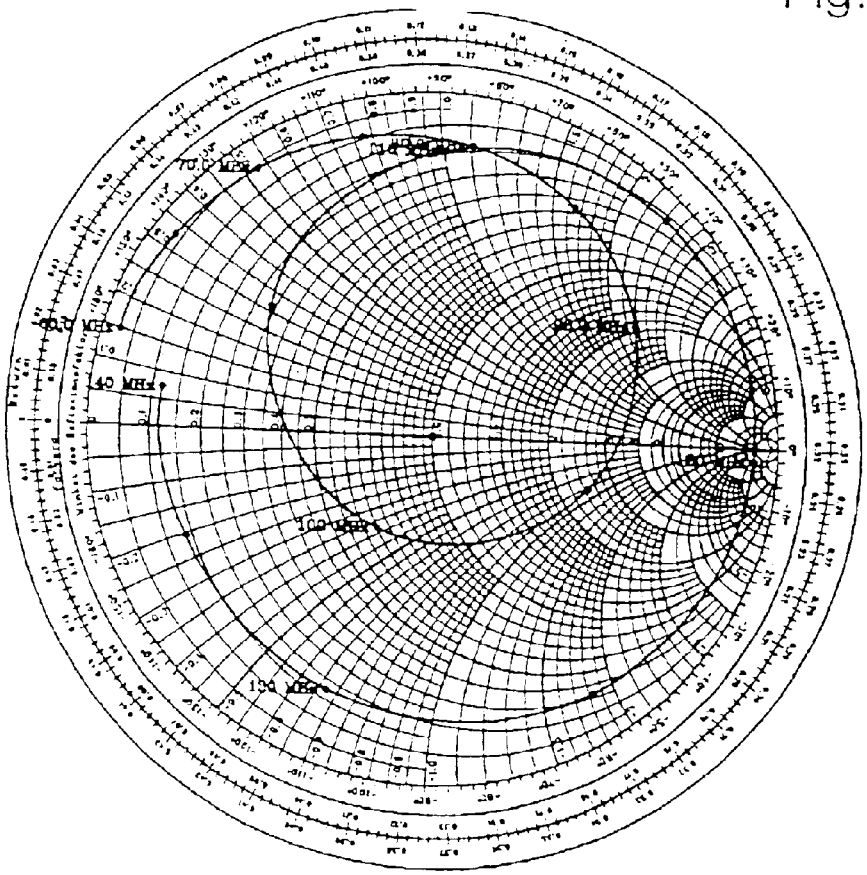

Referring to FIG. 12*a*, there is shown another advantageous embodiment of the invention, wherein the capacitive tuning element 5 is combined with the coupling element 3 by introducing in aperture 1, a conductive surface 17 extending over a large part of the aperture length L in the form of a low-inductance conductor 9. The tuning takes place by suitably realizing the edge spacing 10 in combination with the distributed introduction of the concentrated capacitive construction elements 12. Because of the raised concentration of the magnetic fields within the immediate proximity of the edge, hardly any disadvantageous drop or decline in the self-inductance as a magnetic energy storage of the aperture is connected therewith, provided the edge spacing 10 is not too small. The desired antenna impedance can be adjusted by suitably positioning the antenna connection site 4. This impedance is shown in FIG. 12*b* and has a broad-banded loop in the frequency range of 80 to 100 MHz. By implementing the usual switching measures, this broad-banded impedance can be transformed into a desired impedance curve, for example in the ultra-short wave range.

While several embodiments of the present invention have been shown and described, it is to be understood that many changes and modifications may be made thereunto without departing from the spirit and scope of the invention as defined in the appended claims.

What is claimed:

1. A radio antenna arrangement disposed in the surface of an electrically conductive vehicle chassis and having a connection point comprising:

a substantially rectangular aperture formed in the surface of the vehicle having aperture length L and aperture width B, where B is approximately L/3 or less in the meter wavelength region, wherein said aperture length L is sufficiently small so that the self-resonant frequency (fs) of said aperture is greater than the center frequency of the operating frequency range;

a capacitive tuning element disposed in said aperture for tuning the resonance of the aperture to a resonant frequency $f_o$ to approximately the center frequency of the operating frequency range, said capacitive tuning element acting as capacitive connection between the edges of said aperture, and formed as a low-inductance element so that due to the residual inductive effect, the remaining magnetic reactive power is as small as possible relative to the magnetically generated reactive power from the magnetic fields in said aperture and;

an input coupling element disposed in said aperture for coupling the antenna connection point to the electromagnetic field enhanced by resonance in the aperture.

2. The antenna arrangement according to claim 1, wherein said capacitive tuning element is inserted as a capacitively functioning connection between opposite edges of the longer edges of said aperture spaced apart at an initial space from the center of the aperture and the opposite edges being bridged by at least one low-inductance conductor, which is open-circuited by at least one discontinuity, wherein the capacitive value is selected to be sufficiently large at said at least one discontinuity so as to provide the necessary electric reactive voltage to tune the aperture to the desired resonant frequency.

3. The antenna arrangement according to claim 2, wherein said at least one low-inductance conductor comprises a sufficiently large width conductor, for larger values of said spacing from the aperture center, and at least one concentrated capacitive structural element which is distributed over the width of said large conductor for providing low-inductance capacitive bridging of said at least one discontinuity.

4. The antenna arrangement according to claim 3, wherein only one discontinuity is present, located at one of the aperture edges, so that the entire surface of said low-inductance conductor is conductively connected to the vehicle chassis.

5. The antenna arrangement according to claim 4, wherein said at least one discontinuity of said at least one low-inductance conductor are slits, having a suitable slit-width with respect to the effective slit capacitance between the slit edges so as to provide the desired capacitive effect for said selected large width conductor.

6. The antenna arrangement according to claim 4, wherein said capacitive tuning element using a low-inductance conductor comprises a conductive plane disposed over a large portion of said aperture length L, wherein tuning is determined via suitable formation of the edge spacing of said conductive plane in relation to the distributed concentrated capacitive structural elements, and said low-inductance conductor used in combination as said input coupling element.

7. The antenna arrangement according to claim 1, wherein said capacitive tuning element comprises:

a low-inductance conductor having a narrow cross-sectional dimension disposed in the center of said aperture length L, and, at least one concentrated capacitive structural element coupled to said low-inductance conductor to provide a capacitive impedance to said tuning element.

8. The antenna arrangement according to claim 1, wherein said capacitive tuning element comprises:

a large conducting plane having a length to one-half of aperture length L, and inserted in said aperture as a low-inductance conductor, and having discontinuities defined by the spacing between the edges of said conducting plane and the borders of said aperture, wherein the overall capacitance is determined via low-inductance bridging using several distributed capacitive structural elements.

9. The antenna arrangement according to claim 1, wherein said capacitive tuning element comprises a conducting plane formed as a trough in said aperture, and a plurality of discontinuities formed as continuous dielectrically insulated spaces between the trough edge and the border of said aperture, and wherein said insulated spaces are filled with a suitable dielectric material so as to tune the resonance of said aperture to the desired resonant frequency.

10. The antenna arrangement according to claim 1, wherein said input coupling element comprises;

a magnetic dipole for primary coupling to the resonantly elevated magnetic field, and disposed in said aperture and coupled to said antenna connection point in the given operating frequency region, so that an antenna impedance pattern is obtained having a desired relative impedance value with a sufficiently small contribution to the reflection factor, the antenna impedance pattern being matched to the desired impedance value with the use of capacitive reactive elements without any significant loss, or reduction of bandwidth.

11. The antenna arrangement according to claim 1, wherein the input coupling element for primary coupling to the resonance like elevated electric field as an antenna element, comprises;

an electric dipole disposed in said aperture and coupled to the antenna connection point in the given operating frequency region, to provide an antenna impedance pattern having a desired relative impedance value with a sufficiently small contribution to the reflection factor, whereby said antenna impedance pattern can be matched to the desired impedance value with the use of capacitively reactive elements without any significant loss or reduction of bandwidth.

12. The antenna arrangement according to claim 1 wherein said input coupling element comprises:

an elongated conductor having its antenna connection point disposed between two opposite facing locations at the aperture edges and at a distance dD from the center of said aperture length L, wherein distance dD is chosen sufficiently large so as to provide a sufficiently low impedance level, a series input coupling capacitance coupled to one end of said conductor and an aperture edge to provide a first resonant circuit of a capacitively coupled dual bandpass filter circuit, and, a second resonant circuit of said dual bandpass filter circuit comprising low-loss reactive elements coupled to the opposite end of said elongated conductor and the opposite aperture edge, and wherein said antenna connection point is coupled parallel to said low loss reactive elements.

13. The antenna embodiment according to claim 12, wherein said input coupling element additionally comprises a series inductance wherein the inductance value thereof in combination with the input coupling capacitance and the low-loss reactive elements form a triple bandpass filter circuit having an enlarged bandwidth.

14. The antenna arrangement according to claim 1, wherein said input coupling element comprises an essentially elongated flat conductor connected at one end to the aperture edge, to serve as a conducting ground plane of a microwave antenna for frequencies of higher orders of magnitude.

15. The antenna arrangement according to claim 1 wherein said capacitive tuning element comprises;

a conducting ground plane of a microwave antenna for frequencies of higher orders of magnitude and wherein said input coupling element comprises at least one high-impedance choke connected to the antenna edge, said connection point being connected across said at least one choke for the meter wavelength frequency region.

16. The antenna arrangement according to claim 1 wherein said capacitive tuning element comprises at least one low inductance conductor serving as a capacitive LMK-antenna disposed in said aperture having a plurality of discontinuities, wherein the screening effect of said at least one low-inductance conductor largely eliminate the reception of the low LKW frequencies.

* * * * *